US009170062B2

(12) United States Patent
Corso

(10) Patent No.: US 9,170,062 B2
(45) Date of Patent: Oct. 27, 2015

(54) LOW PROFILE MAGAZINE FOLLOWER WITH ISOLATED SLIDE LOCK LEVER

(71) Applicant: Steven Corso, Jupiter, FL (US)

(72) Inventor: Steven Corso, Jupiter, FL (US)

( * ) Notice: Subject to any disclaimer, the term of this patent is extended or adjusted under 35 U.S.C. 154(b) by 0 days.

(21) Appl. No.: 14/300,403

(22) Filed: Jun. 10, 2014

(65) Prior Publication Data

US 2015/0059222 A1 Mar. 5, 2015

Related U.S. Application Data

(60) Provisional application No. 61/873,631, filed on Sep. 4, 2013.

(51) Int. Cl.

| | |
|---|---|
| ***F41A 9/61*** | (2006.01) |
| ***F41A 9/65*** | (2006.01) |
| *F41A 17/36* | (2006.01) |

(52) U.S. Cl.
CPC .. *F41A 9/65* (2013.01); *F41A 17/36* (2013.01)

(58) Field of Classification Search
CPC ..... F41A 9/70; F41A 9/65; F41A 17/36
USPC ..... 42/7, 18, 49.01, 49.02, 50
See application file for complete search history.

(56) References Cited

U.S. PATENT DOCUMENTS

| | | | | |
|---|---|---|---|---|
| 1,158,981 | A * | 11/1915 | Carl | 42/50 |
| 2,944,357 | A * | 7/1960 | Smith et al. | 42/50 |
| 4,446,645 | A * | 5/1984 | Kelsey et al. | 42/50 |
| 4,811,510 | A * | 3/1989 | Chesnut | 42/50 |
| 6,560,907 | B1 * | 5/2003 | Vieweg | 42/50 |
| 7,530,191 | B2 * | 5/2009 | Szabo | 42/50 |
| 8,650,787 | B2 * | 2/2014 | McCormick | 42/50 |
| 2011/0277366 | A1 * | 11/2011 | Steffes et al. | 42/50 |

* cited by examiner

*Primary Examiner* — Gabriel Klein
(74) *Attorney, Agent, or Firm* — Robert M. Downey, P.A.

(57) ABSTRACT

A firearm magazine follower for use in combination with a magazine tube includes an upper flange, a rear flange and a bottom flange formed from a single, flexible piece of material, such as steel. The upper flange extends from the rear flange and has a top side that is sized and configured for supporting a plurality of bullets thereon. The lower flange extends from the rear flange and has a distal end and a proximal end, and includes first and second surface members are separated lengthwise at a location between the proximal and distal ends of the lower flange. The first surface member is sized and configured for contacting a front inner facing wall of the magazine tube. The second surface member includes a raised flange at the distal end that is sized and configured for contacting and activating the slide lock lever of the magazine tube.

19 Claims, 6 Drawing Sheets

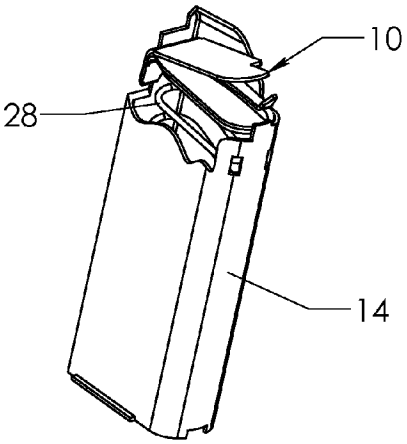
FIG. 1
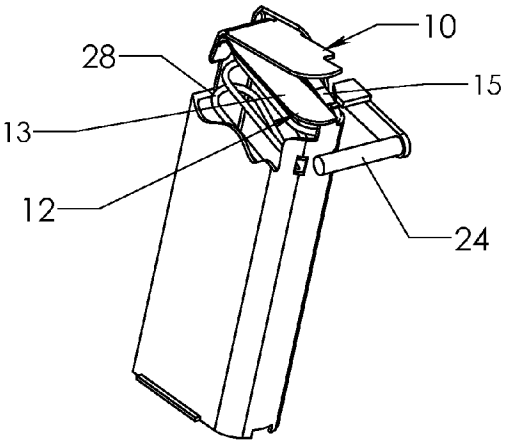
FIG. 2
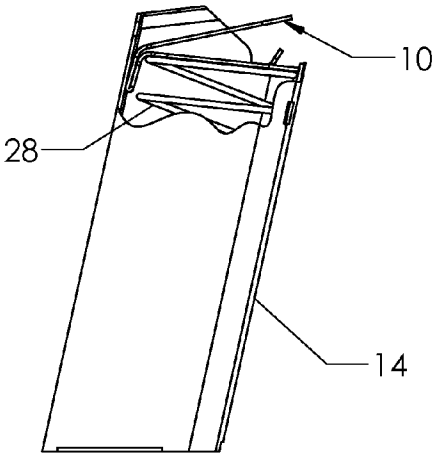
FIG. 3
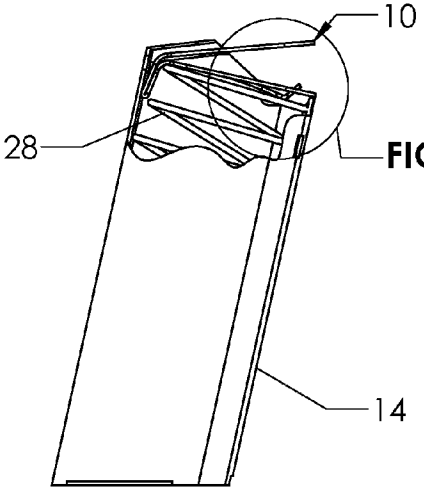
FIG. 4
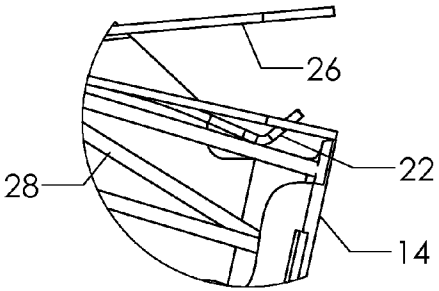
FIG. 4A
FIG. 4A

LOW PROFILE MAGAZINE FOLLOWER WITH ISOLATED SLIDE LOCK LEVER

This patent application is based on provisional patent application Ser. No. 61/873,631 filed on Sep. 4, 2013.

BACKGROUND OF THE INVENTION

1. Field of the Invention

The present invention relates to followers used in a firearm magazines and, more particularly, a low profile follower that allows maximum space for bullets and accommodates the largest possible magazine spring while also improving slide lock reliability and eliminating existing limitations.

2. Discussion of Related Art

Automatic and semi-automatic firearms usually contain a cartridge magazine in which bullets are stored, wherein magazines are generally comprised of a magazine housing, a magazine spring, and a follower. The magazine is designed to automatically load the bullets into position to be stripped and chambered following each time the firearm cycles and, in many instances, to activate the slide lock lever after the last bullet in the magazine is fired. The magazine housing contains the bullets and the magazine spring forces the follower up to keep the next bullet located at the top of the magazine where it can effectively be stripped and chambered.

To get the most compact profile that allows for maximum bullet storage and maximum spring space, followers are commonly made out of steel or spring steel. These stamped steel followers are generally shaped in a slightly obtuse L-shape. The top side is located between the first bullet loaded in the magazine and the magazine spring. The rear flange is located between the back of the magazine spring and the inside back of the magazine housing. On some stamped steel follower designs, the top length remains flat and a second flange is extended from the approximate intersection of the L-bend extending under the top length at an angle to act as a slide lock step. This follower design allows for a low profile as the top length of the part springs down closing the angle between the top length and the slide lock step when the magazine is full. Because of the low profile when loaded, space for bullets and the spring is maximized. Also, since the rear flange is the only edge that protrudes downward, the magazine spring size can be maximized to the width of the magazine housing and the length of the magazine housing minus only the thickness of the rear flange. In some applications, after the last round is chambered, the follower pivots over the front edge of the magazine housing when the slide lock step on the follower contacts the slide lock lever inside the firearm. This pivot can reduce the spring force transferred to the slide lock lever which may reduce the slide lock reliability.

Slide lock reliability is also affected with this type of follower as the follower can "jump" the slide lock lever. Since the bullets must clear the slide lock lever on the way up and out of the magazine housing, the slide lock lever is typically shaped as a right triangle when viewed from the top because of a bullet clearance cut. Since the flat steel follower can pivot, and the slide lock shelf is flat, the flat edge of the slide lock step on the follower rides on the hypotenuse edge instead of the bottom side of the slide lock lever in some applications. The angle of contact between the two can force the follower around and over the slide lock lever. Since the follower slide lock shelf is now above the slide lock lever, it cannot act to lock the slide.

Another problem that occurs in applications when the follower pivots over the top edge of the magazine housing is the magazine housing is prevented from full insertion into the firearm when empty. Full insertion is prevented because as the empty magazine housing is inserted, the slide lock step of the follower contacts the slide lock lever as the follower pivots over the top edge of the magazine housing. When the slide lock lever pivots upward to its end of travel, the follower begins to travel downward against the magazine spring pressure but will stop when it contacts the top edge of the magazine housing as it has pivoted over it. In some applications this may happen before the magazine reaches its fully inserted and locked position. In applications where this is possible, a different, higher profile follower must be used that takes up valuable space inside the magazine housing.

Given the preexisting problem described above, there is a need for a low profile follower that maximizes space for bullets and accommodates the largest possible magazine spring while also improving slide lock reliability and eliminating existing limitations.

BRIEF DESCRIPTION OF THE DRAWINGS

For a fuller understanding of the present invention, reference should be made to the following detailed description taken in conjunction with the accompanying drawings in which:

FIG. 1 is a perspective view of the firearm magazine follower of the present invention installed in a magazine housing;

FIG. 2 is a perspective view of the firearm magazine follower of the present invention installed in a magazine housing;

FIG. 3 is a side elevational view of the firearm magazine follower of the present invention installed in a magazine housing;

FIG. 4 is a side elevational view of the firearm magazine follower of the present invention installed in a magazine housing;

FIG. 4A is a side elevational view of the firearm magazine follower taken from FIG. 4;

Like reference numerals refer to like parts throughout the several views of the drawings.

SUMMARY OF THE INVENTION

Figure 5:
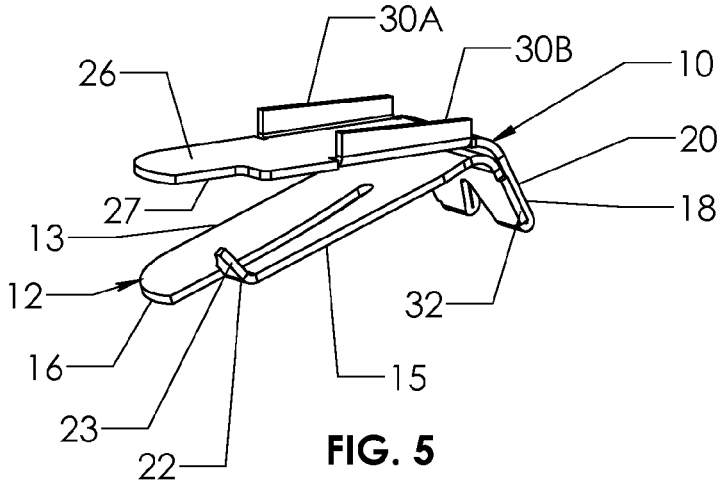
FIG. 5 is a perspective view of the firearm magazine follower of the present invention.

The present invention is directed to a firearm cartridge magazine follower designed to allow the lowest possible profile in order to accommodate maximum storage capacity for bullets, containing the ability to reliably activate the slide lock, and allowing empty magazine insertion into the firearms in a broad range of applications not previously accomplished with this style of follower. The follower is comprised of a thin and strong spring-like material, such as steel or stainless steel. The follower uses the length of a lower flange (slide lock step) of the follower to determine the angle within the magazine housing resulting from follower contact with the front and the rear of the inside wall of the magazine housing. An upper flange that changes angle as the magazine spring pressure increases in response to added ammunition rounds provides more space for the magazine spring when the magazine is fully loaded. The lower follower flange is split lengthwise into two lower flange members including a second lower flange member containing a bend or end shape as necessary for proper slide lock activation and the opposite first lower flange member being either flat or containing a downward bend that will flatten as necessary when the magazine housing is loaded, and together allowing empty insertion into a broad range of firearms. A raised member that is bent in the upward direction at the distal end of the second lower flange member is disposed for raising the forward contact point between the follower and the inside of the magazine housing, which reduces binding and downward pivot of the front of the follower. A split rear flange allows for a larger spring to be used, smoother spring compression, and avoidance of follower contact with the weld, which is typically located in the center of the rear flat wall of the magazine housing. Spacer flanges along the length of the upper flange may be included for spacing the top surface of the follower down from the slide rail when the magazine is empty.

DETAILED DESCRIPTION OF THE PREFERRED EMBODIMENTS

Referring to the several views of the drawings, the firearm magazine follower of the present invention is shown in accordance with a preferred embodiment and is generally indicated as 10.

The firearm magazine follower 10 is made of a thin, strong and spring-like material, such as steel or stainless steel, and includes a lower follower flange 12 and an upper follower flange 26. The lower flange 12 (i.e., slide lock step) has a length selected to form an adequate angle of the follower 10 within the magazine housing 14 of the magazine. The front end 16 of the lower flange 12 contacts an inner facing side of the magazine housing 14, thereby keeping the front end 16 from diving while the rear flange 18 of the follower 10 is approximately in parallel connection with the opposite inner facing side of the magazine housing 14 and preventing the rear end 20 of the follower 10 from rising. The follower 10 remains at an explicit angle once the lower flange 12 enters the magazine housing 14 as additional bullets 42 are loaded in the magazine.

Referring to FIGS. 1-4A, the lower follower flange 12 extends under the main top side of the follower 10 to function as a slide lock step. The lower flange 12 is split lengthwise into two lower flange members 13 and 15 by a gap that extends from a distal end of the lower flange 12 and terminates prior to the rear flange 18. A first lower flange member 13 extends to contact the inside front wall of the magazine housing 14 and determines the angle of the follower 10 within the magazine. The adjacent second lower flange member 15 of the lower flange 12 is shorter and, in one embodiment, includes a bend 22 in the upward direction at the distal end of the surface and forming a raised member 23. The bend 22 may be parallel or perpendicular to the length direction of the lower flange 12. The raised member 23 formed by the bend 22 allows the lower flange 12 to remain within the magazine housing 14 when the raised member 23 contacts and activates the slide lock lever 24 (FIG. 2) within the firearm, thereby preventing the upper flange 26 from pivoting over the top edge of the magazine housing 14 after the last bullet is fed from the magazine. By keeping the lower flange 12 of the follower 10 within the magazine housing 14 when the follower 10 contacts the slide lock lever 24, greater force is transferred to the slide lock lever 24 for more reliable slide lock activation compared to if the follower 10 were allowed to pivot. The lower flange bend 22 also causes further compression of the magazine spring 28, thereby adding to the force used to lock the slide. The bend 22 further assures direct contact with the slide lock lever 24 and avoids edge to edge contact with the hypotenuse edge of the slide lock lever 24 which can cause the follower 10 to ride around and over the slide lock lever 24. In some applications, when an empty magazine housing is inserted into the firearm, the follower 10 may pivot over the front edge of the magazine housing 14.

The two lower flange members 13 and 15 of the lower flange 12 are capable of moving independently. The front end 16 of lower flange 12 that contacts the slide lock lever 24 allows the second lower flange member 15 to spring downward into the magazine housing 14, thereby allowing the magazine housing to travel to its fully inserted position without hard-stopping, even as the first lower flange member 13 remains stopped above the magazine housing 14. The upper follower flange 26 has a relief cut 27 that clears the bend in the lower flange 12 when the magazine is fully loaded and the angle between the lower and upper flanges 12 and 26 is closed. The bend 22 in the slide lock step 12 is offset to avoid interfering with the bullet as the angle between the lower and upper flanges 12 and 26 closes.

Figure 6:
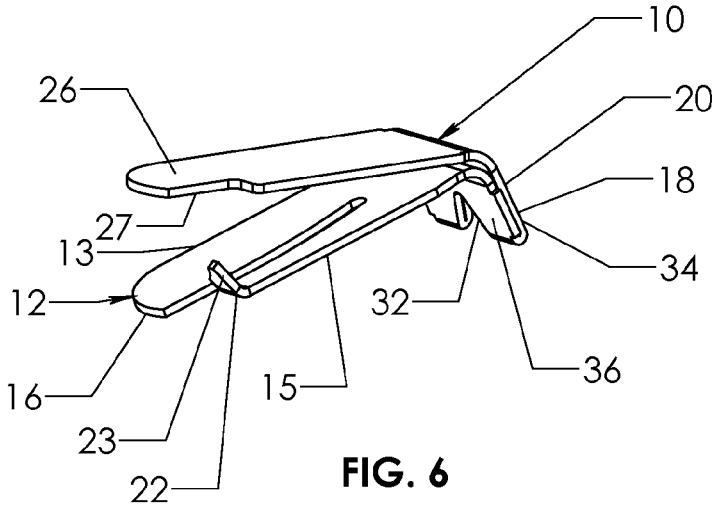
FIG. 6 is a perspective view of the firearm magazine follower of the present invention.
Figure 7:
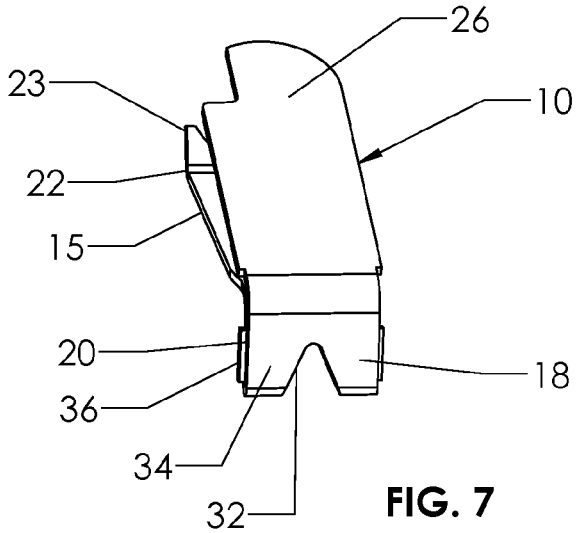
FIG. 7 is a perspective view of the firearm magazine follower of the present invention.
Figure 8:
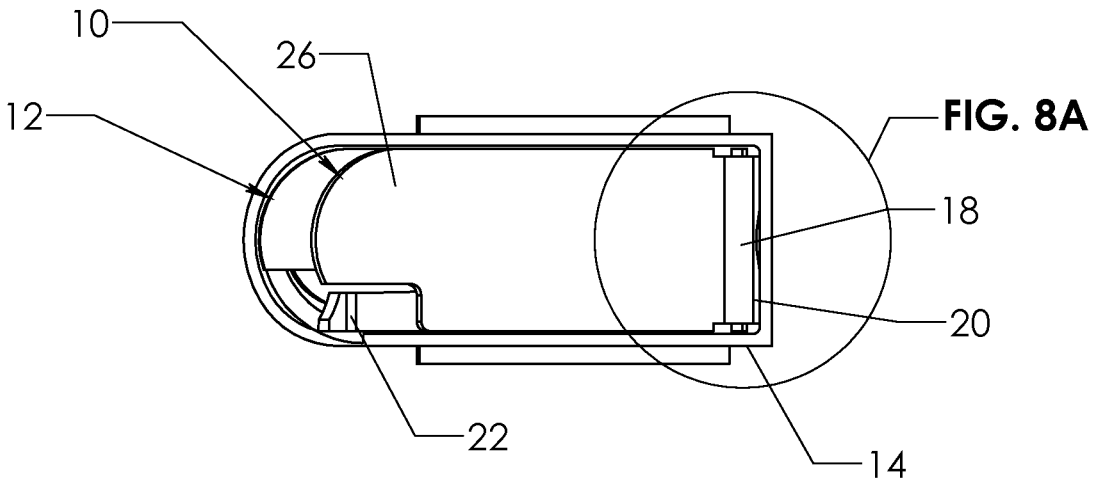
FIG. 8 is a top plan view of the firearm magazine follower of the present invention installed in a magazine housing.
Figure 8A:
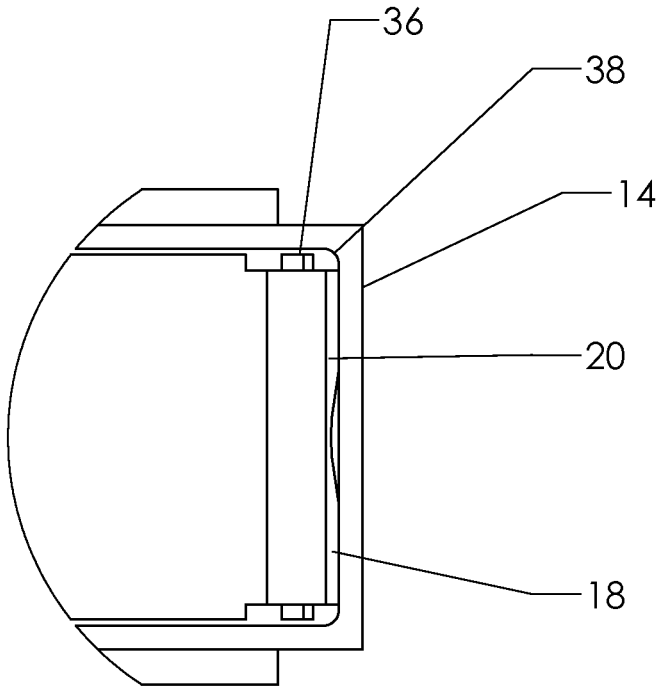
FIG. 8A is a top plan view of the firearm magazine follower installed in a magazine housing taken from FIG. 8.

Referring to FIGS. 5-8A, the follower may further include end-of-travel spacer flanges 30A and 30B (FIG. 5) and a split rear flange 32. The end-of-travel spacer flanges 30A and 30B extend upwards from the top side of the upper flange 26 and each are sized and configured to contact the feed lips of the magazine housing when there are no remaining bullets in the magazine housing, thereby spacing the top surface of the follower down from the open end of the magazine. This space is necessary in certain firearm designs for keeping the pickup rail on the slide from catching the follower as it returns to battery position. Additionally, there may be an angle at the top of the spacer flanges 30A and 30B for determining the angle of the follower 10 when seated against the feed lips, as required in some firearm designs. These spacer flanges 30A and 30B may be necessary whether the split slide lock shelf flange is used or not.

The opening in the split rear flange 32 prevents the magazine spring 28 from catching on the split rear flange 32 as the spring 28 is compressed when bullets 42 are loaded into the magazine housing 14. Additionally, the split rear flange 32 keeps the follower 10 from contacting the center rear surface of the inside of the magazine housing 14 where the weld is commonly located, thereby maintaining smooth movement during operation of the firearm.

The rear flange 18 (and split rear flange 32) consists of two layers of material formed against one another. The outer layer 34 is less wide than the inner layer 36 in order to provide clearance when the follower 10 rides inside the magazine housing 14. The inside rear bends on the magazine housing typically contain a small radius 38 that would prevent the rear flange 18 of the follower 10 from riding directly on the rear surface of the magazine housing 14. When the outer layer 34 is relieved to provide clearance from the radius in the magazine housing 14, the rear flange 18 can ride against the inside rear of the magazine housing 14 while the inner layer 36 of the rear flange 18 can be designed to a width for a precision side-to-side fit within the magazine housing.

Figure 9:
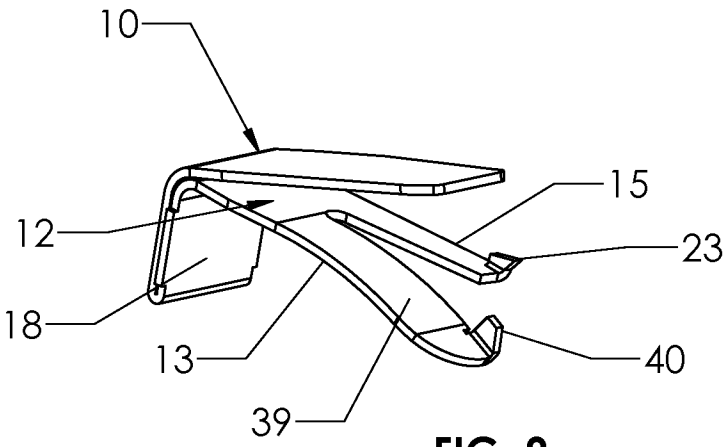
FIG. 9 is a perspective view of the firearm magazine follower of the present invention.
Figure 10A:
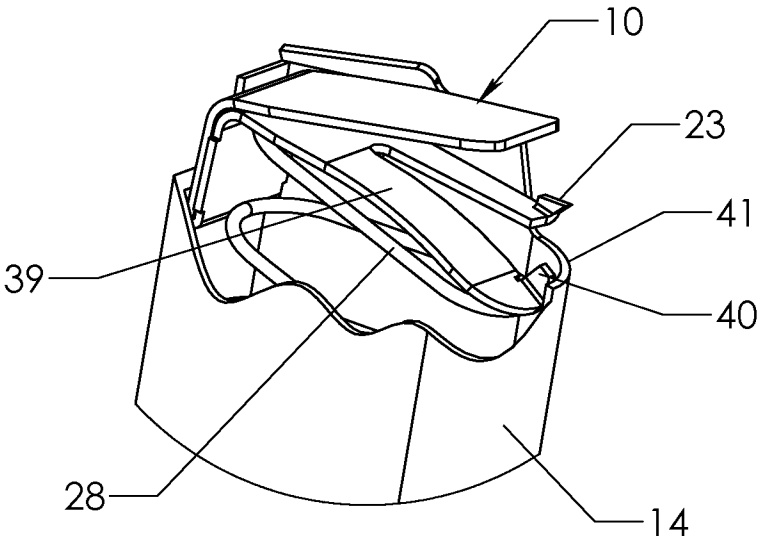
FIG. 10A is a perspective view of the firearm magazine follower taken from FIG. 10.
Figure 10:
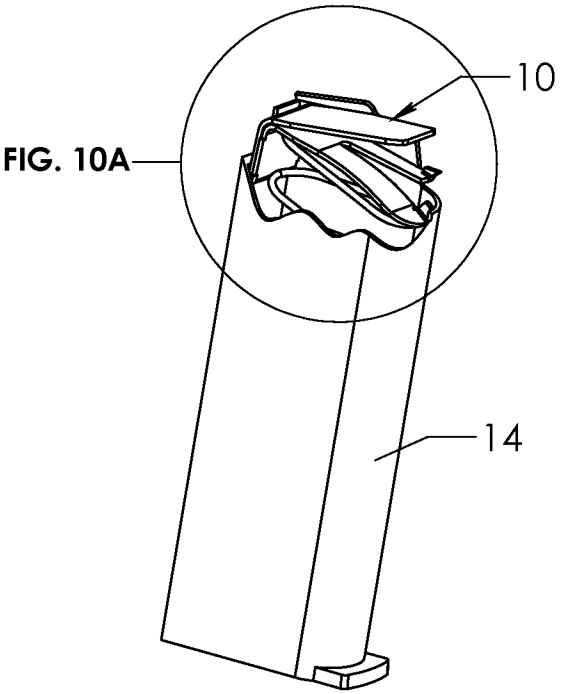
FIG. 10 is a perspective view of the firearm magazine follower of the present invention installed in a magazine housing.
Figure 11A:
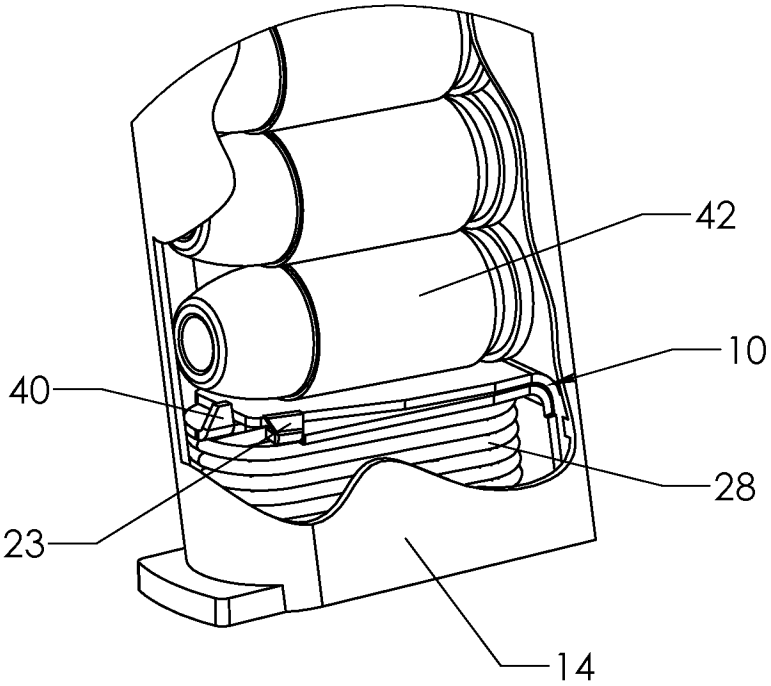
FIG. 11A is a perspective view of the firearm magazine follower taken from FIG. 11.
Figure 11:
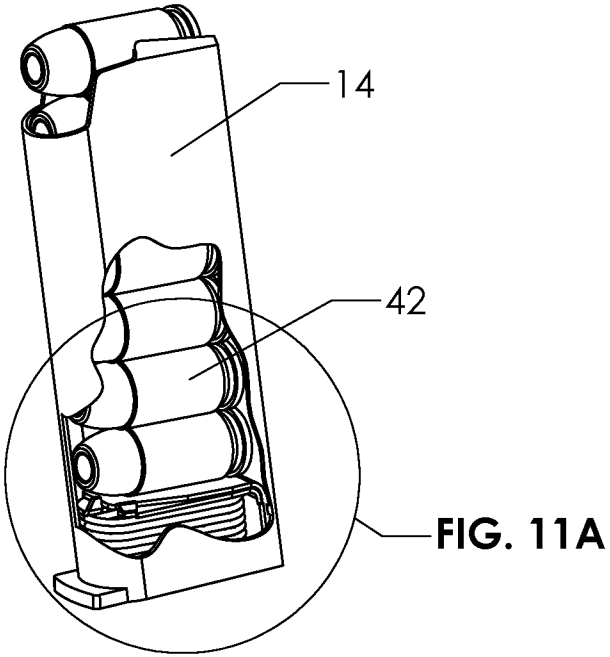
FIG. 11 is a perspective view of the firearm magazine follower of the present invention installed in a magazine housing filled to capacity with bullets.

Referring to FIGS. 9-11A, the first lower flange member 13 of the lower follower flange 12 may further contain a downward sloped bend 39 to keep the lower follower flange 12 below the top edge 41 of the magazine housing 14 when the magazine is empty. The sloped bend 39 is flattened by the compression force applied by loaded bullets 42, thereby allowing for maximum storage of bullets 42 in the magazine. The sloped bend 39 further increases the overall spring pressure of the system without adding any compressed height to the system. The forward end of the first lower flange member 13 may also contain an anti-pivot flange 40 bent in the upward direction. The anti-pivot flange 40 can be parallel or perpendicular to the length of the first lower flange member 13. The anti-pivot bend 40 is disposed for increasing the vertical contact distance and contact angle of the follower 10 between the front and rear contact surfaces of the magazine housing to prevent the follower 10 from binding or pivoting. This anti-pivot bend 40 is sized and configured to avoid contact with the bullet 42 when the magazine housing is fully loaded and the angle between the lower and upper follower flanges 12 and 26 closes.

In a preferred embodiment, the upper flange 26, rear flange 18 and lower flange 12 are formed from a single, flexible piece of material, such as steel. In other embodiments of the follower 10, two or more pieces of material formed from one or more types of material may be welded together or otherwise affixed to form the upper flange 26, rear flange 18 and lower flange 12.

While the present invention has been shown and described in accordance with preferred and practical embodiments thereof, it is recognized that departures from the instant disclosure are contemplated within the spirit and scope of the present invention.

What is claimed is:

1. A firearm magazine follower for use in combination with a magazine housing having an open top end and a firearm having a slide lock lever, and said firearm magazine follower comprising:

an upper flange having a flat, planar configuration with a top side that is sized and configured for supporting a plurality of bullets thereon, and said upper flange further including a distal end and an opposite rear end;

a lower flange extending below said upper flange and having a proximal portion, and said lower flange including a first lower flange member and a second lower flange member that are separated lengthwise by a longitudinal gap so that said first and second lower flange members extend freely from the proximal portion of said lower flange and independent of one another and terminate at respective distal ends that are spaced and separated from one another with the gap therebetween;

said first lower flange member being sized and configured for contacting a front inner facing wall of the magazine housing; and said second lower flange member having a longitudinal length that is shorter than a longitudinal length of said first lower flange member, and said second lower flange member being sized and configured for contacting and activating the slide lock lever of the firearm.

2. The firearm magazine follower as recited in claim 1 further comprising a raised flange member at the distal end of said second lower flange member, and said raised flange member being sized and configured for contacting and activating the slide lock lever of the firearm in order to prevent said lower flange from pivoting over the open top end of the magazine housing when the last one of the plurality of bullets is discharged from the top side of said upper flange.

3. The firearm magazine follower as recited in claim 2 wherein said upper flange has a relief cut extending at least partially along one side of said upper flange for allowing passage of the raised flange member on said second lower flange member when said upper flange is moved towards said lower flange.

4. The firearm magazine follower as recited in claim 1 further comprising at least one spacer flange extending from the top side of said upper flange, and said at least one spacer flange being sized and configured for contacting the feed lips of the magazine housing when the last one of the plurality of bullets is discharged from the top side of said upper flange, thereby spacing the top side of said upper flange from the open top end of the magazine housing.

5. The firearm magazine follower as recited in claim 1 wherein said first lower flange member is sloped in the downward direction such that the distal end of said first lower flange member is lower than the proximal portion of said lower flange for increasing the spring force of said first lower flange member and maintaining the distal end of said first lower flange member beneath the open top end of the magazine housing when the last one of the plurality of bullets is discharged from the top side of said upper flange.

6. The firearm magazine follower as recited in claim 1 wherein said first lower flange member includes an anti-pivot flange extending upwards from the distal end of said first lower flange member, and said anti-pivot flange being sized and configured for contacting the front inner facing wall for reducing downward pivot of the distal ends of said lower flange.

7. The firearm magazine follower as recited in claim 1 further comprising:

a rear flange extending downwardly and outwardly from said rear end of said upper flange.

8. The firearm magazine follower as recited in claim 7 wherein said upper flange, said rear flange and said lower flange are formed from a single, flexible piece of material.

9. The firearm magazine follower as recited in claim 8 wherein said single, flexible piece of material is made from steel.

10. The firearm magazine follower as recited in claim 7 wherein said rear flange further includes left and right bottom edge portions positioned below and rearward of the rear end of said upper flange and at a lowermost portion of the rear flange, and the left and right bottom edge portions being separated by a central opening to define a split configuration of the rear flange.

11. A firearm magazine follower for use in combination with a magazine housing having an open top end and a firearm having a slide lock lever, and said firearm magazine follower comprising:

an upper flange, a rear flange and a lower flange formed from a single, flexible piece of material;

said upper flange extending forward from said rear flange, and said upper flange having a top side that is sized and configured for supporting a plurality of bullets thereon, and said upper flange including a distal end and an opposite rear end; and said lower flange extending from said rear flange and having a proximal portion adjacent to said rear flange, and said lower flange including a first lower flange member and a second lower flange member that are separated lengthwise by a longitudinal gap so that said first and second lower flange members extend freely from the proximal portion of said lower flange and independent of one another and terminate at respective distal ends that are spaced and separated from one another with the gap therebetween; wherein said first lower flange member is sized and configured for contacting a front inner facing wall of the magazine housing; and wherein said second lower flange member is sized and configured for contacting and activating the slide lock lever of the firearm.

12. The firearm magazine follower as recited in claim 11 further comprising at least one spacer flange extending from the top side of said upper flange, and said at least one spacer flange being sized and configured for contacting the feed lips of the magazine housing when the last one of the plurality of bullets is discharged from the top side of said upper flange, thereby spacing the top side of said upper flange from the open top end of the magazine housing.

13. The firearm magazine follower as recited in claim 11 wherein said single, flexible piece of material is made from steel.

14. The firearm magazine follower as recited in claim 11 wherein said first lower flange member is sloped in the downward direction such that the distal end of said first lower flange member is lower than the proximal portion of said lower flange for increasing the spring force of said first lower flange member and maintaining the distal end of said first lower flange member beneath the open top end of the magazine housing when the last one of the plurality of bullets is discharged from the top side of said upper flange.

15. The firearm magazine follower as recited in claim 11 wherein said first lower flange member includes an anti-pivot flange extending upwards from the distal end of said first lower flange member, and said anti-pivot flange being sized and configured for contacting the front inner facing wall for reducing downward pivot of the distal ends of said lower flange.

16. The firearm magazine follower as recited in claim 11 wherein said first lower flange member is sized and configured for contacting a front inner facing wall of the magazine housing.

17. The firearm magazine follower as recited in claim 11 wherein said second lower flange member includes a raised flange at the distal end and being sized and configured for contacting and activating the slide lock lever of the firearm in order to prevent said lower flange from pivoting over the open top end of the magazine housing when a last one of the plurality of bullets is discharged from the top side of said upper flange.

18. The firearm magazine follower as recited in claim 17 wherein said upper flange has a relief cut extending at least partially along one side of said upper flange for allowing passage of the raised flange member on said second lower flange member when said upper flange is moved towards said lower flange.

19. The firearm magazine follower as recited in claim 11 wherein said rear flange further includes left and right bottom edge portions positioned below and rearward of the rear end of said upper flange and at a lowermost portion of the rear flange, and the left and right bottom edge portions being separated by a central opening to define a split configuration of the rear flange.

* * * * *